US009995068B2

(12) United States Patent
Sato et al.

(10) Patent No.: US 9,995,068 B2
(45) Date of Patent: Jun. 12, 2018

(54) CASING DEVICE AND ELECTRONIC EQUIPMENT

(71) Applicant: NEC Platforms, Ltd., Kawasaki-shi, Kanagawa (JP)

(72) Inventors: Junichi Sato, Kanagawa (JP); Shigeru Ohsawa, Kanagawa (JP)

(73) Assignee: NEC Platforms, Ltd., Kawasaki-shi, Kanagawa (JP)

( * ) Notice: Subject to any disclaimer, the term of this patent is extended or adjusted under 35 U.S.C. 154(b) by 0 days. days.

(21) Appl. No.: 14/893,977

(22) PCT Filed: Jun. 18, 2014

(86) PCT No.: PCT/JP2014/066750
§ 371 (c)(1),
(2) Date: Nov. 25, 2015

(87) PCT Pub. No.: WO2015/002036
PCT Pub. Date: Jan. 8, 2015

(65) Prior Publication Data

US 2016/0123051 A1 May 5, 2016

(30) Foreign Application Priority Data

Jul. 3, 2013 (JP) ..... 2013-139379

(51) Int. Cl.
*E05B 63/12* (2006.01)
*E05C 19/12* (2006.01)
(Continued)

(52) U.S. Cl.
CPC ..... *E05C 19/12* (2013.01); *E05B 63/12* (2013.01); *E05B 65/00* (2013.01); *E05C 3/10* (2013.01);
(Continued)

(58) Field of Classification Search
CPC ..... E05B 65/00; E05B 63/12; E05C 19/12; E05C 7/04; E05C 9/1875; E05C 9/02;
(Continued)

(56) References Cited

U.S. PATENT DOCUMENTS 3,780,547 A * 12/1973 Drumheller ..... E05B 65/0014 292/107
4,050,272 A * 9/1977 Tanaka ..... E05B 65/0811 292/26
(Continued)

FOREIGN PATENT DOCUMENTS

CN 102966271 A 3/2013
CN 202913809 U 5/2013
(Continued)

OTHER PUBLICATIONS

Written Opinion of the International Searching Authority of PCT/JP2014/066750 dated Sep. 22, 2014.
(Continued)

*Primary Examiner* — Lloyd A Gall
(74) *Attorney, Agent, or Firm* — Sughrue Mion, PLLC

(57) ABSTRACT

A door locking device includes: a pivot end wall portion extending from a pivot end side of a door 131, and having a first through-hole formed therein; an opposed wall portion 20 being opposed to the pivot end wall portion when the door 131 is closed, and having a second through-hole 23A, 23B formed therein; a key cylinder including a movable element 33 configured to be displaced in accordance with unlocking/locking operation; and a pivot hook 40A, 40B configured to interlock with the movable element 33. When the door is unlocked, the pivot hook 40A, 40B retreats to an inner side of the door 131 with respect to the first through-hole, whereas when the door is locked, the pivot hook enters
(Continued)

the second through-hole 23A, 23B via the first through-hole to keep the door 131 and a door 132 closed.

6 Claims, 9 Drawing Sheets

(51) Int. Cl.
*E05C 3/10* (2006.01)
*E05C 7/04* (2006.01)
*E05C 9/02* (2006.01)
*E05C 9/18* (2006.01)
*E05B 65/00* (2006.01)

(52) U.S. Cl.
CPC ..... *E05C 7/04* (2013.01); *E05C 9/02* (2013.01); *E05C 9/1875* (2013.01)

(58) Field of Classification Search
CPC ..... E05C 3/10; Y10T 292/0848; Y10T 292/0849; Y10T 292/0854; Y10T 292/086
USPC ..... 70/123, DIG. 65; 292/44, 45, 48, 53, 292/117, 119; 109/67
See application file for complete search history.

(56) References Cited

U.S. PATENT DOCUMENTS 4,643,005 A * 2/1987 Logas ..... E05C 9/026 292/20
4,875,721 A * 10/1989 Okamoto ..... E05C 9/02 126/197
4,914,932 A * 4/1990 Walla ..... E05B 9/086 70/367
5,542,720 A * 8/1996 Fleming ..... E05B 63/20 292/32
5,722,704 A * 3/1998 Chaput ..... E05B 65/0811 292/26
6,152,498 A * 11/2000 Lindqvist ..... E05C 9/1875 292/195
6,637,784 B1 * 10/2003 Hauber ..... E05B 63/242 292/300
2010/0117384 A1 * 5/2010 Cole ..... E05C 9/02 292/341.17
2012/0146346 A1 * 6/2012 Hagemeyer ..... E05B 63/143 292/217

FOREIGN PATENT DOCUMENTS

JP 31-007700 Y 5/1956
JP 51-102494 U 8/1976
JP 53-017049 Y 5/1978
JP 55-022133 Y2 5/1980
JP 62-038371 U 3/1987
JP 02-002853 Y2 1/1990
JP 05-295939 A 11/1993
JP 11-347225 A 12/1999
JP 2007-278004 A 10/2007
JP 2009-035911 A 2/2009
JP 2012-219583 A 11/2012

OTHER PUBLICATIONS

International Search Report of PCT/JP2014/066750 dated Sep. 22, 2014.
Communication dated Nov. 2, 2016, from the State Intellectual Property Office of People's Republic of China in counterpart Application No. 201480037027.6.

* cited by examiner

CASING DEVICE AND ELECTRONIC EQUIPMENT

CROSS REFERENCE TO RELATED APPLICATIONS

This is a National Stage of International Application No. PCT/JP2014/066750 filed Jun. 18, 2014, claiming priority based on Japanese Patent Application No. 2013-139379 filed Jul. 3, 2013, the contents of all of which are incorporated herein by reference in their entirety.

TECHNICAL FIELD

This invention relates to a door locking device configured to lock a door, which is applied to an electronic apparatus including a hinged door arranged in an opening portion of a casing.

BACKGROUND ART

As an electronic apparatus including a hinged door that is arranged in an opening portion of a casing and needs to be locked, there is exemplified an apparatus called an outdoor apparatus serving as an apparatus constructing a system for a self-service gas station. The outdoor apparatus is used, for example, to specify fueling conditions and a payment method for a fueling bill, and to pay the fueling bill.

In general, the outdoor apparatus is used under a state in which the casing of the outdoor apparatus is accommodated in a dedicated rack placed in the self-service gas station. A top surface, a bottom surface, right and left side surfaces, and a rear surface of the casing of the outdoor apparatus are surrounded by wall surfaces of the rack, whereas a front surface (front) thereof is exposed from the rack. Normally, on the front surface of the casing, there is arranged a single-hinged door or a set of double doors (double-hinged doors) capable of being locked by door locking means. A touch-panel display, a slot for cash such as paper money, and an issuing slot for a receipt are arranged in the door. The door locking means is further arranged in the door, and the door is opened in such a manner that a person who is allowed to open the door, such as an attendant of the self-service gas station, unlocks the door locking means. This configuration allows the person to access an inside of the outdoor apparatus so that the person can replenish sheets for the receipt, collect cash stored in the casing, and maintain and repair the outdoor apparatus.

Note that, as the door locking means of the outdoor apparatus, there is employed locking performed in such a manner that, on a pivot end side of the door, that is, at a position where, in a case of double doors, right and left doors are brought into abutment on each other when the doors are closed, or at a position where, in a case of a single-hinged door, a pivot end side of the door and an opening side of the casing are brought into abutment on each other when the door is closed, holes are formed to pass through both the members brought into abutment on each other, or a projection with a hole is formed in both the members brought into abutment on each other, and then a bolt (also called a shackle, a hook, or the like) of a padlock is inserted into the holes of both the members.

Incidentally, cash such as paper money is stored in the casing of the outdoor apparatus for conducting payment. Accordingly, such a crime may occur that the door is wrenched open using a crowbar or the like in order to steal cash stored in the outdoor apparatus. As described above, the casing of the outdoor apparatus is accommodated in the dedicated rack, and the rack normally has sufficient strength capable of resisting an action of wrenching the door open using a crowbar or the like. Accordingly, against the action of wrenching the door open using a crowbar or the like, it is unnecessary to take measures for the top surface, the bottom surface, the right and left side surfaces, and the rear surface of the casing of the outdoor apparatus surrounded by the wall surfaces of the rack.

However, the door on the front surface of the casing is exposed from the rack, and hence it is necessary to take measures for the door on the front surface against the action of wrenching the door open using a crowbar or the like. Note that, the outdoor apparatus has such structure that it is difficult to take out cash stored in the casing unless the door is opened even if a part of the door is broken. Accordingly, in order to ensure crime prevention, it is only necessary to take measures to prevent the door from being opened.

A type of the door locking device configured to lock the hinged door of the electronic apparatus is disclosed in, for example, Patent Literature 1. However, the locking device disclosed in Patent Literature 1 is intended to be applied to a game machine such as a pachinko machine placed in a pachinko parlor where an attendant can keep an eye on a crime. Thus, no measures are taken against the action of wrenching the door open using a crowbar or the like.

PRIOR ART DOCUMENTS

Patent Document

Patent Document 1: JP-A-H11-347225

SUMMARY OF THE INVENTION

Problem to be Solved by the Invention

As measures against the above-mentioned action of wrenching the door open using a crowbar or the like, on a hinge portion side being a fulcrum of pivot of the door, the hinge portion is designed and manufactured into solid structure. Thus, it is possible to obtain structure capable of resisting the action of wrenching the door open using a crowbar or the like.

On the other hand, it is difficult to obtain the structure capable of resisting the action of wrenching the door open using a crowbar or the like at the following positions: a position where, in a case of double doors, right and left doors are brought into abutment on each other when the doors are closed; a position where, in a case of a single-hinged door, a pivot end side of the door and an opening side of the casing are brought into abutment on each other when the door is closed; and a position where an upper side or a lower side of the door is brought into abutment on the opening side of the casing when the door is closed.

Further, in a case of using a padlock as the door locking means, the pivot end side, the upper side, and the lower side of the door are weak in resisting the action of wrenching the door open using a crowbar or the like. In addition, a bolt of the padlock may be relatively easily cut.

Therefore, it is an object of this invention to provide a door locking device excellent to achieve crime prevention.

Means to Solve the Problem

According to one embodiment of this invention, there is provided a door locking device configured to lock a hinged door, which is applied to an electronic apparatus including the hinged door arranged in an opening portion of a casing, the door locking device including: a pivot end wall portion extending from a pivot end side of the hinged door toward an inner side of the hinged door, and having a first through-hole formed therein; an opposed wall portion being opposed to the pivot end wall portion when the hinged door is closed, and having a second through-hole formed therein correspondingly to the first through-hole; a key cylinder fixed to the hinged door, the key cylinder including a movable element arranged on the inner side of the hinged door, which is configured to be displaced in a pivoting manner between an unlocked position and a locked position in accordance with unlocking/locking operation performed on an outer side of the hinged door; and a pivot hook having a hook shape, and being mounted on the inner side of the hinged door so as to interlock with the movable element of the key cylinder, in which when the movable element is at the unlocked position, the pivot hook retreats to the inner side of the hinged door with respect to the first through-hole of the pivot end wall portion, and in which when the movable element is at the locked position, the pivot hook enters the second through-hole of the opposed wall portion via the first through-hole of the pivot end wall portion to keep the hinged door closed.

The first through-hole may be a plurality of first through-holes formed in line along the pivot end side. The second through-hole may be a plurality of second through-holes formed correspondingly to the plurality of first through-holes. The pivot hook may be a plurality of pivot hooks arranged correspondingly to the plurality of first through-holes and the plurality of second through-holes. The plurality of pivot hooks may be connected through a connection bar so as to interlock with each other.

The pivot hook may include a retaining portion having a retaining surface that is positioned in parallel to a wall surface of the opposed wall portion on a side opposite to the pivot end wall portion when the pivot hook enters the second through-hole of the opposed wall portion via the first through-hole.

The door locking device may further include a flange portion formed along an outer surface of the hinged door so as to protrude from the pivot end side, the flange portion being configured to cover a clearance defined between the pivot end wall portion and the opposed wall portion when the hinged door is closed.

The opposed wall portion may be formed in the opening portion of the casing.

Alternatively, the electronic apparatus may further include a second door for forming a set of double doors together with the hinged door, and the opposed wall portion may be formed so as to extend from a pivot end side of the second door toward an inner side of the second door.

Further, according to one embodiment of this invention, there is provided an electronic apparatus, including the door locking device, the casing, and the hinged door.

Effect of the Invention

The door locking device according to the one embodiment of this invention is excellent to achieve crime prevention.

MODES FOR EMBODYING THE INVENTION

A door locking device according to this invention is a device configured to lock a door, which is applied to an electronic apparatus including a hinged door arranged in an opening portion of a casing.

The door locking device according to this invention includes a pivot end wall portion, an opposed wall portion, a key cylinder, and a pivot hook. The pivot end wall portion extends from a pivot end side of the door toward an inner side of the door, and has a first through-hole formed therein. The opposed wall portion is opposed to the pivot end wall portion when the door is closed, and has a second through-hole formed therein correspondingly to the first through-hole. The key cylinder is fixed to the door, and includes a movable element (crank member) arranged on the inner side of the door, which is configured to be displaced in a pivoting manner between an unlocked position and a locked position in accordance with unlocking/locking operation performed on an outer side of the door.

The pivot hook has a hook shape, and is mounted on the inner side of the door so as to interlock with the movable element of the key cylinder. When the movable element is at the unlocked position, the pivot hook retreats to the inner side of the door with respect to the first through-hole of the pivot end wall portion, whereas when the movable element is at the locked position, the pivot hook enters the second through-hole of the opposed wall portion via the first through-hole of the pivot end wall portion to keep the door closed.

With the above-mentioned configuration, in the door locking device according to this invention, the pivot hook firmly keeps the pivot end wall portion and the opposed wall portion of the closed doors overlapping each other. Accordingly, even if a crowbar is inserted into a clearance defined at the pivot end side of the door, it is difficult to wrench the doors open by tearing up the doors with the crowbar by leverage action. Thus, the door locking device is excellent to achieve crime prevention.

Now, with reference to the drawings, description is made of a door locking device according to specific embodiments of this invention.

First Embodiment

Figure 1:
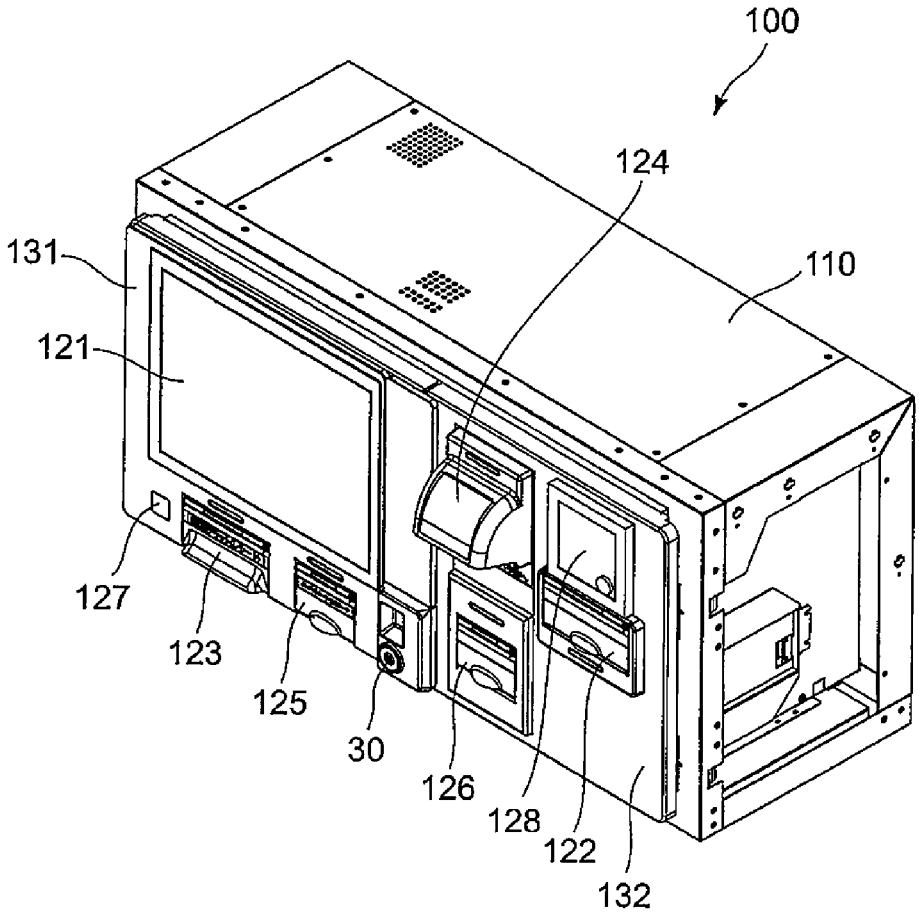
FIG. 1 is a perspective view of an outdoor apparatus including a door locking device according to embodiments of this invention.
Figure 2:
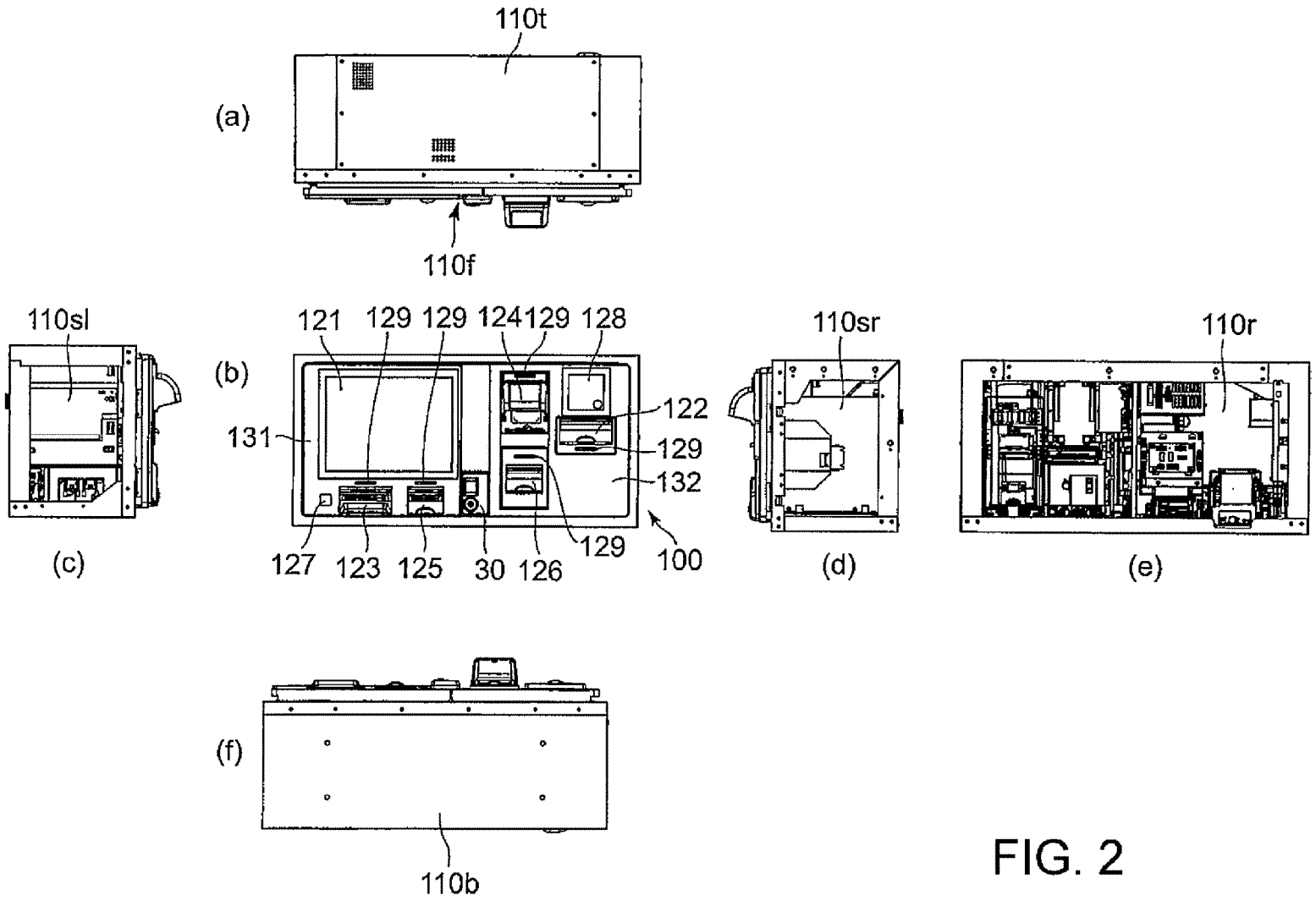
FIG. 2 shows views of the outdoor apparatus illustrated in FIG. 1, in which (*a*), (*b*), (*c*), (*d*), (*e*), and (*f*) are respectively a top view, a front view, a left-hand side view, a right-hand side view, a rear view, and a bottom view.
Figure 3:
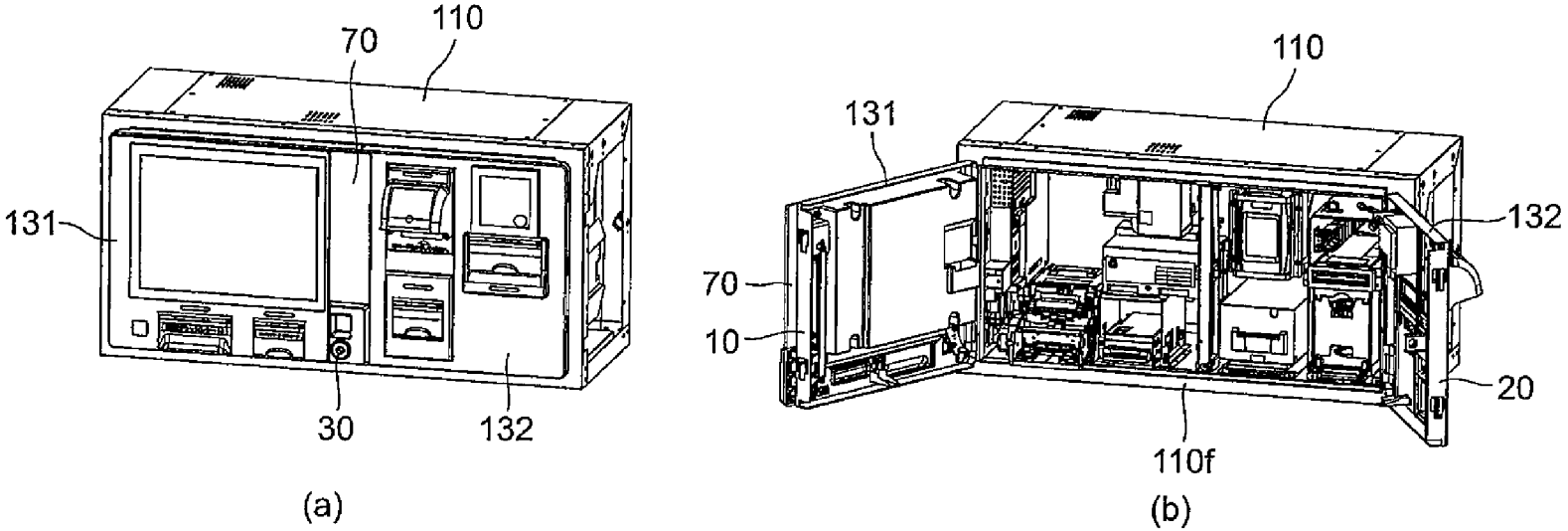
FIG. 3 shows perspective views of the outdoor apparatus illustrated in FIG. 1, in which (*a*) is an illustration of a door-closed state, and (*b*) is an illustration of a door-open state.

With reference to FIG. 1 to FIG. 3, a door locking device according to a first embodiment of this invention includes a hinged door arranged in an opening portion of a casing. As an electronic apparatus including the door that needs to be locked, there is exemplified an outdoor apparatus 100 serving as an apparatus constructing a system for a self-service gas station. The outdoor apparatus is used, for example, to specify fueling conditions and a payment method for a fueling bill, and to pay the fueling bill.

The outdoor apparatus 100 is used under a state in which a casing 110 of the outdoor apparatus 100 is accommodated in a dedicated rack (not shown) placed in the self-service gas station. Accordingly, a top surface 110*t*, a bottom surface 110*b*, a left side surface 110*s*1, a right side surface 110sr, and a rear surface 110*r* of the casing 110 of the outdoor apparatus 100 are surrounded by firm wall surfaces of the rack. Meanwhile, a front surface (front) 110*f* is exposed from the rack.

On the front surface 110*f* of the casing 110 exposed from the rack, a hinged door 131 is arranged. In this embodiment, in particular, there is further arranged a door 132 being a second door and forming a set of double doors (double-hinged doors) together with the door 131 being a first door. Note that, the door 131 and the door 132 are manufactured by press working a metal with high viscosity, such as stainless steel or a plated steel sheet.

As illustrated in FIG. 1 and the like, in the door 131, there are arranged a touch-panel display 121, an issuing slot 123 for a receipt, an insertion slot 125 for cards, and a motion sensor 127. In the door 132, there are arranged a slot 122 for paper money, a reader 124 for a two-dimensional barcode printed on a receipt and the like, an insertion slot 126 for cards different from those of the insertion slot 125, and an interphone 128.

Figure 7:
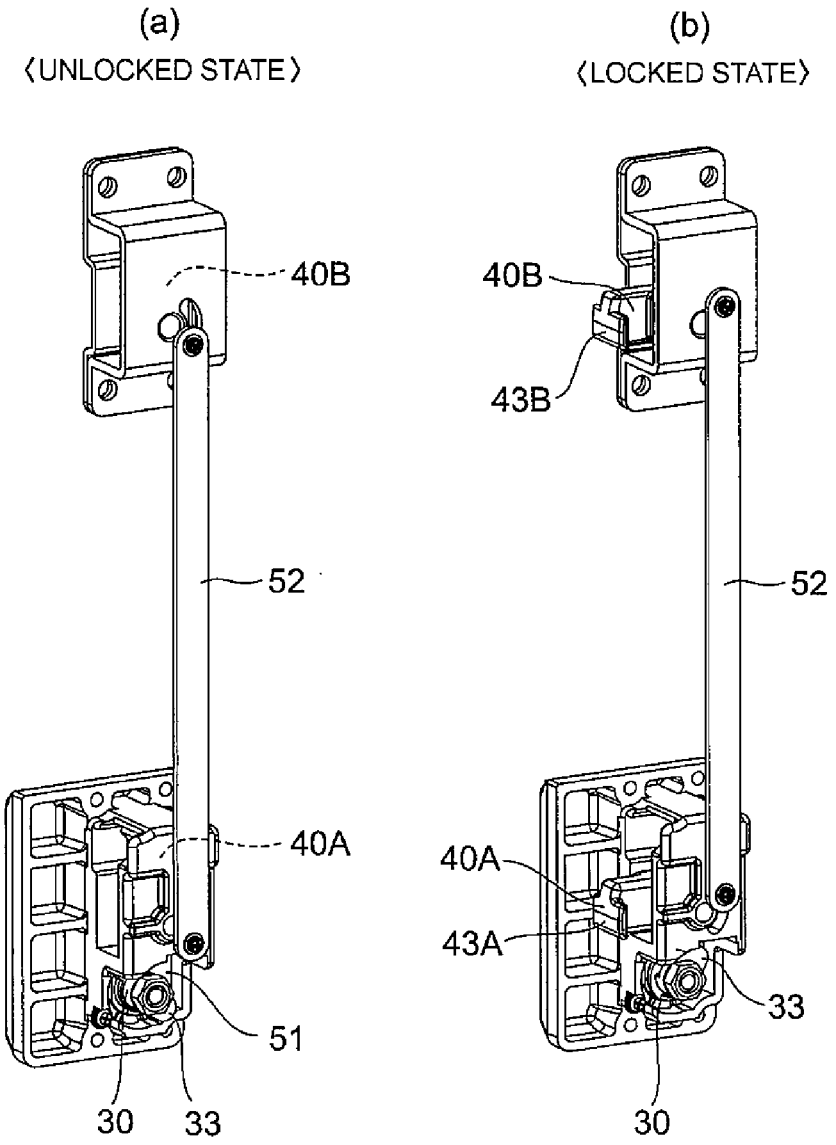
FIG. 7 shows views of a main part of the door locking device according to the embodiments of this invention, in which (*a*) is an illustration of an unlocked state, and (*b*) is an illustration of a locked state.
Figure 8:
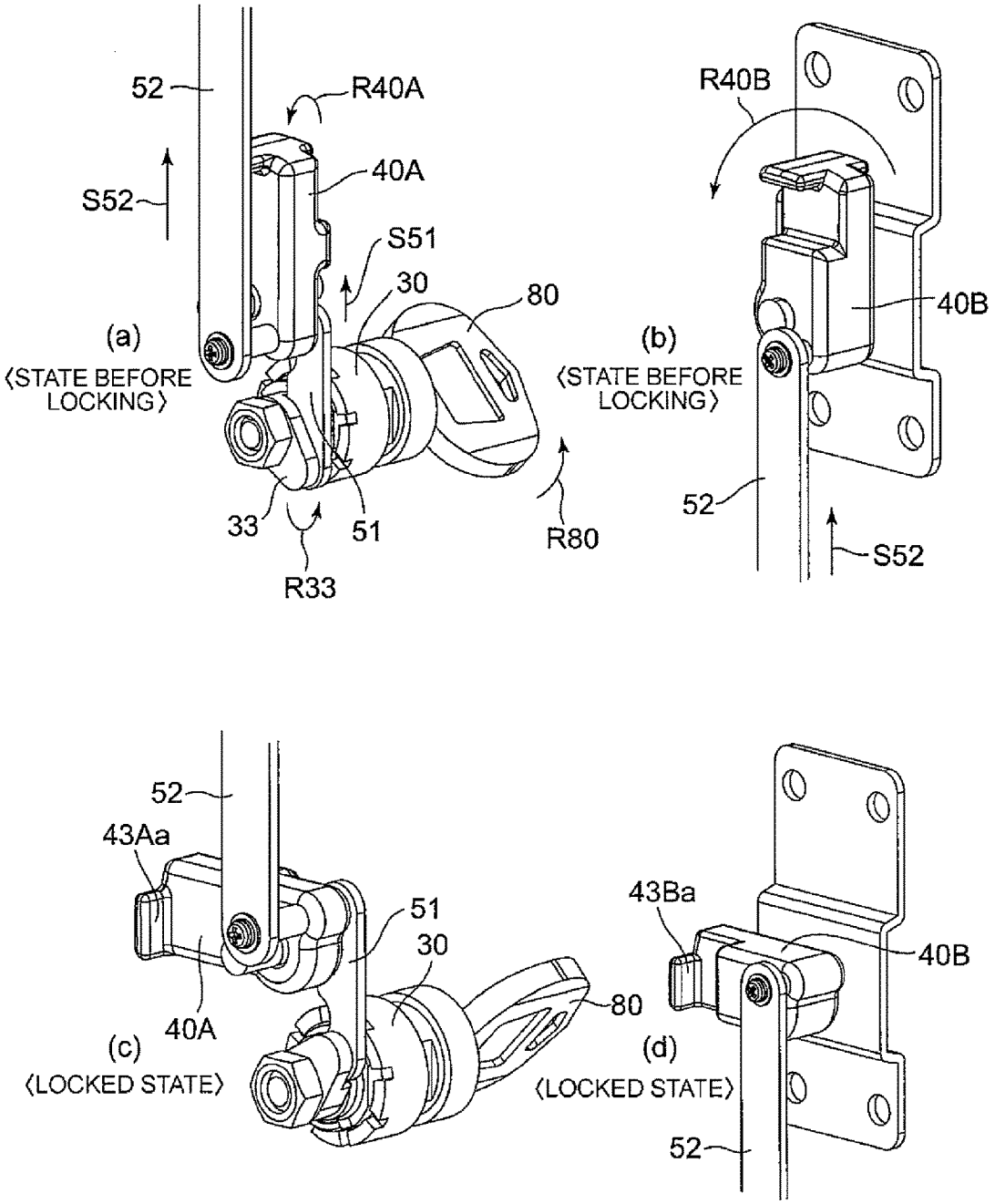
FIG. 8 shows views for illustrating operation of the door locking device according to the embodiments of this invention, in which (*a*) and (*b*) are illustrations of a state before locking, and (*c*) and (*d*) are illustrations of the locked state.
Figure 9:
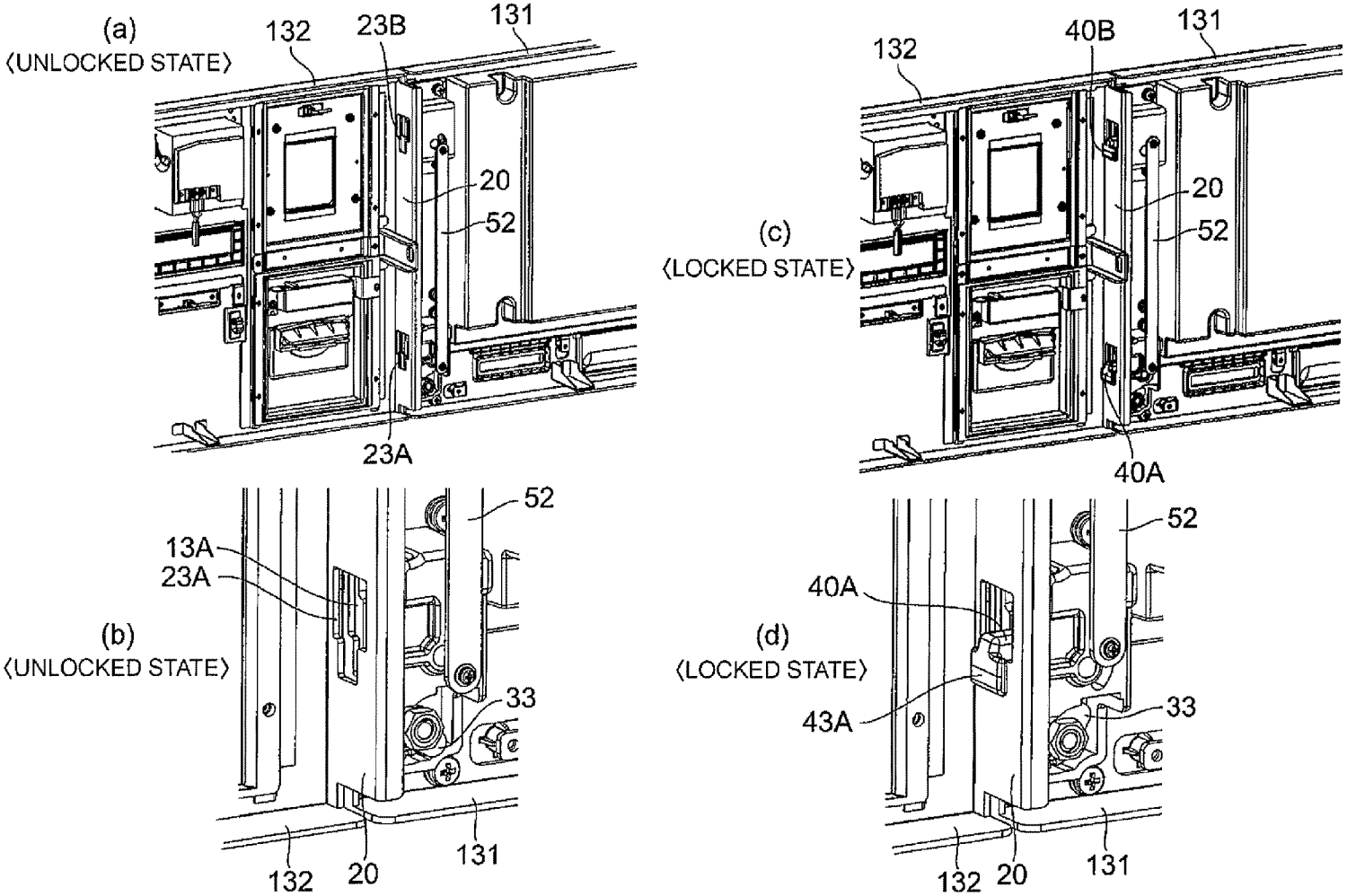
FIG. 9 shows rear views of the doors, for illustrating the operation of the door locking device according to the embodiments of this invention, in which (*a*) and (*b*) are illustrations of the unlocked state, and (*c*) and (*d*) are illustrations of the locked state.

With reference to FIG. 1 to FIG. 3 and FIG. 4 to FIG. 9, the door locking device according to this embodiment includes a pivot end wall portion 10, an opposed wall portion 20, a key cylinder 30, and pivot hooks 40A and 40B. Note that, in FIG. 8, for easy understanding of description, illustrations of components for covering the pivot hooks 40A and 40B are omitted. Further, FIG. 9 are rear views of the doors.

Figure 4:
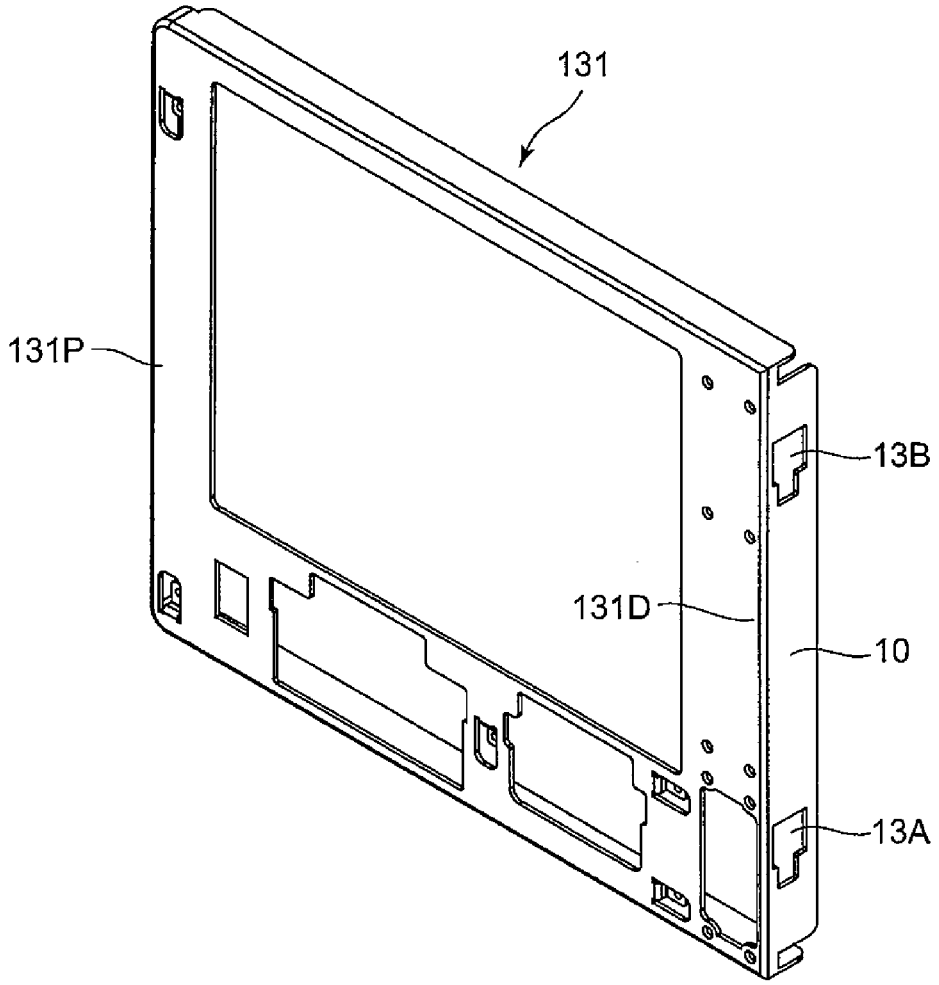
FIG. 4 is a perspective view of a door (first door) of the outdoor apparatus illustrated in FIG. 1.

As illustrated in FIG. 4 and the like, the pivot end wall portion 10 extends toward an inner side of the door 131 from a pivot end side 131D (FIG. 4) of the door 131, and has first through-holes 13A and 13B formed therein. The plurality of first through-holes 13A and 13B are formed in line along the pivot end side 131D. Note that, reference symbol 131P in FIG. 4 denotes a pivot base side of the door 131. The pivot base side 131P is pivotably supported in the opening portion of the front surface 110*f* of the casing 110 to form a hinge mechanism. With this configuration, the door 131 can be opened and closed as a hinged door.

Figure 5:
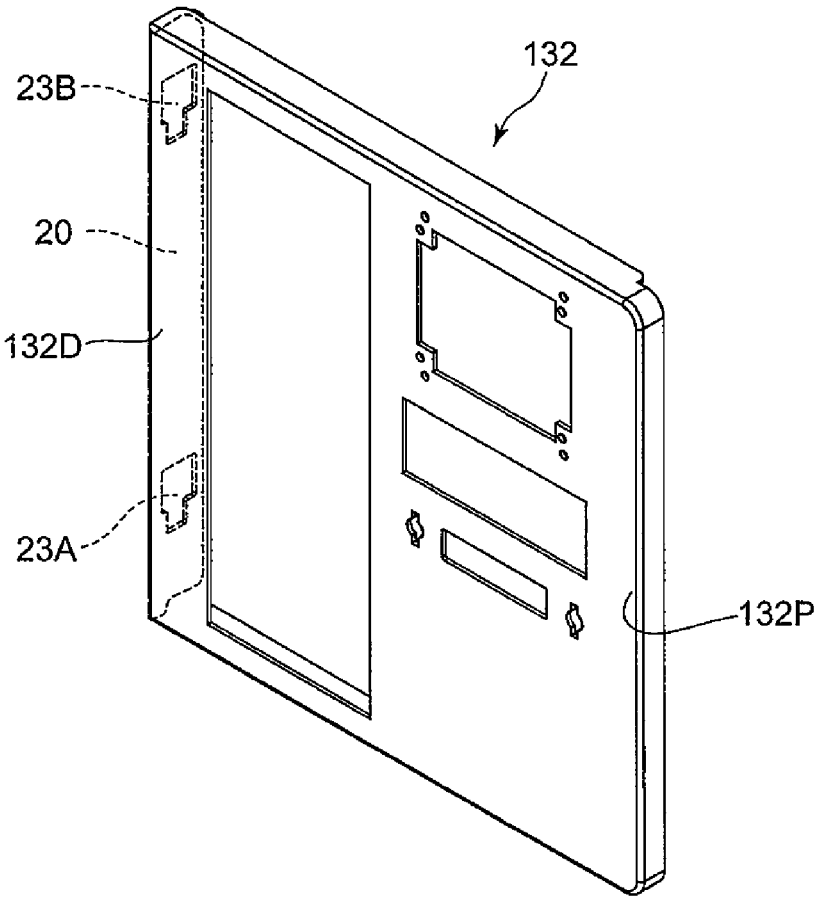
FIG. 5 is a perspective view of a second door of the outdoor apparatus illustrated in FIG. 1.
Figure 6:
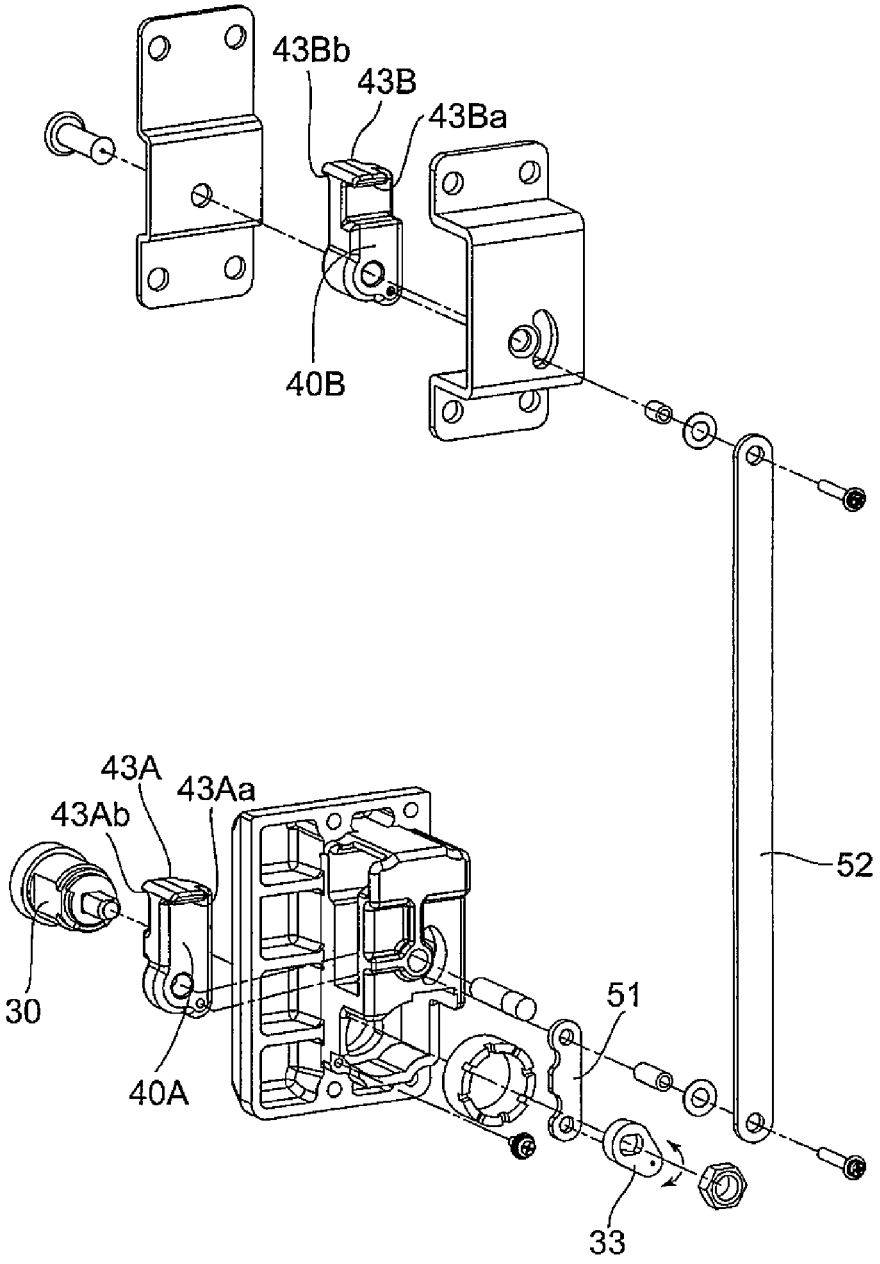
FIG. 6 is an exploded perspective view of a main part of the door locking device according to the embodiments of this invention.

As illustrated in FIG. 5 and the like, the opposed wall portion 20 is opposed to the pivot end wall portion 10 when the door 131 is closed, and the opposed wall portion 20 has second through-holes 23A and 23B formed therein correspondingly to the first through-holes 13A and 13B. In this embodiment, in particular, the opposed wall portion 20 extends toward an inner side of the door 132 from a pivot end side 132D of the door 132. The plurality of second through-holes 23A and 23B are formed in line along the pivot end side 132D correspondingly to the plurality of first through-holes 13A and 13B. Note that, reference symbol 132P in FIG. 5 denotes a pivot base side of the door 132. The pivot base side 132P is pivotably supported in the opening portion of the front surface 110*f* of the casing 110 to form a hinge mechanism. With this configuration, the door 132 can be opened and closed as a hinged door.

With reference to FIG. 6 to FIG. 9, the key cylinder 30 is fixed to the door 131 through intermediation of a plate member, and includes a movable element (crank member) 33 arranged on the inner side of the door 131 and configured to be displaced in a pivoting manner between an unlocked position and a locked position in accordance with unlocking/locking operation performed with a key 80 on an outer side of the door 131.

The pivot hooks 40A and 40B each have a hook shape, and are mounted on the inner side of the door 131 so as to interlock with the movable element 33 of the key cylinder 30 through link members 51 and 52. Note that, in FIG. 8, the arrow R80 indicates an operating direction of the key 80 when an unlocked state before locking is shifted to a locked state; the arrow R33, an operating direction of the movable element 33; the arrow S51, an operating direction of the link member 51; the arrow S52, an operating direction of the link member 52; the arrow R40A, an operating direction of the pivot hook 40A; and the arrow R40B, an operating direction of the pivot hook 40B.

Note that, the plate member configured to support the key cylinder 30, the link members 51 and 52, the pivot hooks 40A and 40B, and the like are manufactured by casting a metal with high viscosity, such as stainless steel.

Further, in this invention, the number of the pivot hooks is not limited to two. One pivot hook or three or more pivot hooks may be prepared as needed.

When the movable element 33 is at the unlocked position (FIG. 7(*a*), FIG. 8(*a*), FIG. 8(*b*), FIG. 9(*a*), and FIG. 9(*b*)), the pivot hooks 40A and 40B retreat to the inner side of the door 131 with respect to the first through-holes 13A and 13B of the pivot end wall portion 10.

On the other hand, when the movable element 33 is at the locked position (FIG. 7(*b*), FIG. 8(*c*), FIG. 8(*d*), FIG. 9(*c*), and FIG. 9(*d*)), the pivot hooks 40A and 40B enter narrow portions of the second through-holes 23A and 23B of the opposed wall portion 20 via the first through-holes 13A and 13B of the pivot end wall portion 10, thereby keeping the door 131 and the door 132 closed. At this time, the pivot hooks 40A and 40B firmly keep the pivot end wall portion 10 of the closed door 131 and the opposed wall portion 20 of the closed door 132 overlapping each other. In particular, in this embodiment, the pivot hook 40A includes a retaining portion 43A having retaining surfaces 43Aa and 43Ab that are positioned in parallel to a wall surface of the opposed wall portion 20 on a side opposite to the pivot end wall portion 10 when the pivot hook 40A enters the second through-hole 23A of the opposed wall portion 20 via the first through-hole 13A, and the pivot hook 40B includes a retaining portion 43B having retaining surfaces 43Ba and 43Bb that are positioned in parallel to the wall surface of the opposed wall portion 20 on the side opposite to the pivot end wall portion 10 when the pivot hook 40B enters the second through-hole 23B of the opposed wall portion 20 via the first through-hole 13B. With this configuration, the pivot hooks 40A and 40B can be prevented from slipping off the opposed wall portion 20. Accordingly, the pivot hooks 40A and 40B further firmly keep the pivot end wall portion 10 and the opposed wall portion 20 overlapping each other against a force of cancelling the keeping. Note that, under a locked state, the retaining surfaces 43Aa and 43Ab, and the retaining surfaces 43Ba and 43Bb are opposed to a back surface of the opposed wall portion 20 with a slight gap. Further, only any one of the retaining surfaces 43Aa and 43Ab of the retaining portion 43A may be formed, and only any one of the retaining surfaces 43Ba and 43Bb of the retaining portion 43B may be formed.

Note that, even when the door 131 and the door 132 are closed, a slight clearance (for example, approximately 3 mm) is defined between the both doors (between the pivot end wall portion 10 and the opposed wall portion 20). The clearance is needed in order to ensure a margin for a dimensional tolerance of each component, and to avoid collision between the pivot end sides at the time of pivot of the doors. However, a crowbar or the like may be inserted into the clearance. Therefore, the door locking device according to this invention further includes a flange portion 70 that is formed along an outer surface of the door 131 so as to protrude from the pivot end side 131D, and is configured to cover the clearance defined between the both doors (between the pivot end wall portion 10 and the opposed wall portion 20) when the doors are closed. Note that, the flange portion 70 is manufactured by casting a metal with high viscosity, such as stainless steel.

Second Embodiment

A door locking device according to a second embodiment of this invention is different from the door locking device according to the first embodiment in that the door locking device according to the second embodiment is applied to an electronic apparatus including a single-hinged door, and that an opposed wall portion is formed in an opening portion of a casing. Accordingly, the same components as or similar components to those of the first embodiment are described with reference to the description and drawings of the first embodiment, and detailed description thereof is omitted.

Although not shown, similarly to the first embodiment, the door locking device according to the second embodiment of this invention is applied to an outdoor apparatus serving as an apparatus constructing a system for a self-service gas station, which is exemplified as an electronic apparatus including the door that needs to be locked. However, in this embodiment, the outdoor apparatus includes the single-hinged door arranged in the opening portion of the casing.

In the self-service gas station, the single-hinged door is arranged on a front surface of the casing exposed from a dedicated rack. Note that, the door is manufactured by press working a metal with high viscosity, such as stainless steel or a plated steel sheet.

The door locking device according to the second embodiment of this invention includes, similarly to the first embodiment, a pivot end wall portion, an opposed wall portion, a key cylinder, and pivot hooks.

The pivot end wall portion extends from a pivot end side of the door toward an inner side of the door, and has a first through-hole formed therein. A plurality of first through-holes are formed in line along the pivot end side.

The opposed wall portion is opposed to the pivot end wall portion when the door is closed, and has a second through-hole formed therein correspondingly to the first through-hole.

In this embodiment, in particular, the opposed wall portion is formed so as to extend from an opening side of the opening portion of the front surface of the casing toward an inside of the casing. A plurality of second through-holes are formed in line along the opening side correspondingly to the plurality of first through-holes.

The key cylinder is fixed to the door through intermediation of a plate member, and includes a movable element arranged on the inner side of the door and configured to be displaced in a pivoting manner between an unlocked position and a locked position in accordance with unlocking/locking operation performed with a key on an outer side of the door.

The pivot hooks each have a hook shape, and are mounted on the inner side of the door so as to interlock with the movable element of the key cylinder through link members.

Note that, the plate member configured to support the key cylinder, the link members, the pivot hooks, and the like are manufactured by casting a metal with high viscosity, such as stainless steel.

Further, when the movable element is at the unlocked position, the pivot hooks retreat to the inner side of the door with respect to the first through-holes of the pivot end wall portion.

On the other hand, when the movable element is at the locked position, the pivot hooks enter narrow portions of the second through-holes of the opposed wall portion formed in the casing via the first through-holes of the pivot end wall portion, thereby keeping the door closed. At this time, the pivot hooks firmly keep the pivot end wall portion and the opposed wall portion overlapping each other.

Also in this embodiment, each pivot hook may include a retaining portion having a retaining surface that is positioned in parallel to a wall surface of the opposed wall portion on a side opposite to the pivot end wall portion when the pivot hook enters the second through-hole of the opposed wall portion via the first through-hole. In this case, the pivot hook further firmly keeps the pivot end wall portion and the opposed wall portion overlapping each other against a force of cancelling the keeping. Note that, under a locked state, the retaining surface is opposed to a back surface of the opposed wall portion with a slight gap.

Further, even when the door is closed, a slight clearance (for example, approximately 1.5 mm) is defined between the door and the opening portion of the casing (between the pivot end wall portion and the opposed wall portion). The clearance is needed in order to ensure a margin for a dimensional tolerance of each component, and to avoid collision between the pivot end side and the opening side at the time of pivot of the door. However, a crowbar or the like may be inserted into the clearance. Therefore, the door locking device according to this invention may include a flange portion that is formed along an outer surface of the door so as to protrude from the pivot end side, and is configured to cover the clearance defined between the pivot end wall portion and the opposed wall portion when the door is closed. Note that, the flange portion is manufactured by casting a metal with high viscosity, such as stainless steel.

INDUSTRIAL APPLICABILITY

As a matter of course, this invention is not limited to the embodiments described above, and may be modified into various modes within a technical scope described in the claims. For example, description is herein made of the embodiments each relating to the door locking device applied to the outdoor apparatus that is employed for a self-service gas system as the electronic apparatus. However, this invention is also applicable to all types of electronic apparatus s including a hinged door that is arranged in an opening portion of a casing and needs to be locked.

Further, this application claims the benefit of priority from Japanese Patent Application No. 2013-139379, filed on Jul. 3, 2013, the entire disclosure of which is incorporated herein by reference.

REFERENCE SIGNS LIST

10 pivot end wall portion
13A, 13B first through-hole
20 opposed wall portion
23A, 23B second through-hole
30 key cylinder
33 movable element
40A, 40B pivot hook
43A, 43B retaining portion
43Aa, 43Ab, 43Ba, 43Bb retaining surface
51, 52 link member
70 flange portion
80 key
100 outdoor apparatus
110 casing
110*f* front surface (front)
131, 132 door

The invention claimed is:

1. A casing device comprising a casing, a hinged door arranged in an opening portion of the casing and a door locking device locking the hinged door, wherein the hinged door comprises a pivot end wall portion extending from a pivot end side of the hinged door toward an inner side of the hinged door, and having a first through-hole formed therein, wherein the casing comprises an opposed wall portion being opposed to the pivot end wall portion when the hinged door is closed, and having a second through-hole formed therein correspondingly to the first through-hole, wherein the door locking device comprises:

a key cylinder fixed to the hinged door, the key cylinder comprising a movable element arranged on the inner side of the hinged door, which is configured to be displaced in a pivoting manner between an unlocked position and a locked position in accordance with unlocking and locking operations performed on an outer side of the hinged door; and a pivot hook having a hook shape, and being mounted on the inner side of the hinged door so as to interlock with the movable element of the key cylinder, wherein the hinged door and the pivot hook are made of metal, wherein the first through-hole is provided with a first narrow portion, and the second through-hole is provided with a second narrow portion, wherein when the movable element is at the unlocked position, the pivot hook retreats to the inner side of the hinged door with respect to the first through-hole of the pivot end wall portion, wherein when the movable element is at the locked position, the pivot hook enters the second through-hole of the opposed wall portion via the first through-hole of the pivot end wall portion to keep the hinged door closed, and wherein the pivot hook comprises:

a narrow corresponding portion entering the first narrow portion and the second narrow portion when the pivot hook enters the second through-hole of the opposed wall portion via the first through-hole; and retaining flange portions having flange shapes, which are extended from both end sides of the narrow corresponding portion, respectively, and preventing the pivot hook, which is inserted in the second through-hole of the opposed wall portion via the first through-hole, from being removed from the opposed wall portion, wherein the retaining flange portions are provided with flat and rectangular surfaces at the both end sides of the narrow corresponding portion, respectively, wherein the flat surfaces are shaped such that when the pivot hook enters the second through-hole of the opposed wall portion via the first through-hole, the flat surfaces face in parallel with a flat wall surface of the opposed wall portion opposed to the pivot end wall portion and the flat surfaces cover the entirety of the second narrow portion, wherein, when the hinged door is closed, a side edge of the narrow corresponding portion is opposed to an inner side edge of the first narrow portion and an inner side edge of the second narrow portion with a first slight gap so as to restrict the hinged door from opening beyond the first slight gap, and wherein, when the hinged door is closed, the flat and rectangular surfaces of the retaining flange portions are respectively opposed to both flat wall surfaces of the second through-hole with a second slight gap disposed therebetween so as to restrict the pivot end wall portion receding from the opposed wall portion beyond the second slight gap.

2. The casing device according to claim 1, wherein the first through-hole comprises a plurality of first through-holes formed in line along the pivot end side, wherein the second through-hole comprises a plurality of second through-holes formed correspondingly to the plurality of first through-holes, wherein the pivot hook comprises a plurality of pivot hooks arranged correspondingly to the plurality of first through-holes and the plurality of second through-holes, and wherein the plurality of pivot hooks are connected through a connection bar so as to interlock with each other.

3. The casing device according to claim 1, wherein the hinged door further comprises a flange portion formed along an outer surface of the hinged door so as to protrude from the pivot end side, the flange portion being configured to cover a clearance defined between the pivot end wall portion and the opposed wall portion when the hinged door is closed.

4. The casing device according to claim 1, wherein the opposed wall portion is formed in the opening portion of the casing.

5. A casing device comprising a casing, a hinged door arranged in an opening portion of the casing, a second door for forming a set of double doors together with the hinged door, and a door locking device locking the hinged door, wherein the hinged door comprises a pivot end wall portion extending from a pivot end side of the hinged door toward an inner side of the hinged door, and having a first through-hole formed therein, wherein the second door comprises an opposed door wall portion which is formed so as to extend from a pivot end side of the second door toward an inner side of the second door and which is opposed to the pivot end wall portion when the hinged door is closed, and having a second through-hole formed therein corresponding to the first through-hole, wherein the door locking device comprises:

a key cylinder fixed to the hinged door, the key cylinder comprising a movable element arranged on the inner side of the hinged door, which is configured to be displaced in a pivoting manner between an unlocked position and a locked position in accordance with unlocking and locking operations performed on an outer side of the hinged door; and a pivot hook having a hook shape, and being mounted on the inner side of the hinged door so as to interlock with the movable element of the key cylinder, wherein the hinged door, the second door and the pivot hook are made of metal, wherein the first through-hole is provided with a first narrow portion, and the second through-hole is provided with a second narrow portion, wherein when the movable element is at the unlocked position, the pivot hook retreats to the inner side of the hinged door with respect to the first through-hole of the pivot end wall portion, wherein when the movable element is at the locked position, the pivot hook enters the second through-hole of the opposed wall portion via the first through-hole of the pivot end wall portion to keep the hinged door closed, and wherein the pivot hook comprises:

a narrow corresponding portion entering the first narrow portion and the second narrow portion when the pivot hook enters the second through-hole of the opposed wall portion via the first through-hole; and retaining flange portions having flange shapes, which are extended from both end sides of the narrow corresponding portion, respectively, and preventing the pivot hook, which is inserted in the second through-hole of the opposed wall portion via the first through-hole, from being removed from the opposed wall portion, wherein the retaining flange portions are provided with flat and rectangular surfaces at the both end sides of the narrow corresponding portion, respectively, wherein the flat surfaces are shaped such that when the pivot hook enters the second through-hole of the opposed wall portion via the first through-hole, the flat surfaces face in parallel with a flat wall surface of the opposed wall portion opposed to the pivot end wall portion and the flat surfaces cover the entirety of the second narrow portion, wherein, when the hinged door is closed, a side edge of the narrow corresponding portion is opposed to an inner side edge of the first narrow portion and an inner side edge of the second narrow portion with a first slight gap so as to restrict the hinged door from opening beyond the first slight gap, and wherein, when the hinged door is closed, the flat and rectangular surfaces of the retaining flange portions are respectively opposed to both flat wall surfaces of the second through-hole with a second slight gap disposed therebetween so as to restrict the pivot end wall portion receding from the opposed wall portion beyond the second slight gap.

6. An electronic apparatus, comprising the casing device according to any one of the claims 1, 2, 3, 4 and 5.

* * * * *